US007121948B2

(12) United States Patent
Huthmacher et al.

(10) Patent No.: US 7,121,948 B2
(45) Date of Patent: Oct. 17, 2006

(54) SLIDING CLUTCH FOR A DEVICE FOR TRANSFERRING A FILM FROM A BACKING TAPE

(75) Inventors: Winfried Huthmacher, Franfurt am Main (DE); Roland Schneider, Kelkheim (DE)

(73) Assignee: Societe BIC, Clichy, Cedex (FR)

( * ) Notice: Subject to any disclaimer, the term of this patent is extended or adjusted under 35 U.S.C. 154(b) by 0 days.

(21) Appl. No.: 11/166,732

(22) Filed: Jun. 24, 2005

(65) Prior Publication Data

US 2005/0239556 A1 Oct. 27, 2005

Related U.S. Application Data

(60) Division of application No. 10/379,653, filed on Mar. 6, 2003, now abandoned, which is a continuation of application No. PCT/EP01/05671, filed on May 17, 2001.

(30) Foreign Application Priority Data

Sep. 8, 2000 (EP) ..... 00119642

(51) Int. Cl.
*F16D 7/02* (2006.01)

(52) U.S. Cl. ..... 464/41; 242/422.9

(58) Field of Classification Search ..... 464/30, 464/34, 40, 41, 57; 192/56.1, 56 R, 75–77; 156/540; 242/422.4, 422.8, 422.9, 545.1; 279/43.8; 267/167

See application file for complete search history.

(56) References Cited

U.S. PATENT DOCUMENTS

| | | | | |
|---|---|---|---|---|
| 198,777 | A | 1/1878 | Nicholson | 279/43.8 |
| 2,048,372 | A * | 7/1936 | Carlsson et al. | 192/77 |
| 2,729,320 | A * | 1/1956 | Henrickson | |
| 2,907,190 | A | 10/1959 | Lee | 464/30 |
| 3,443,375 | A | 5/1969 | Cielaszyk | 464/41 X |
| 4,718,971 | A | 1/1988 | Summers | |
| 4,750,878 | A | 6/1988 | Nix et al. | |
| 4,891,090 | A | 1/1990 | Lorincz et al. | |
| 5,685,944 | A | 11/1997 | Nose et al. | |
| 5,759,341 | A | 6/1998 | Kobayashi | 156/540 |
| 6,145,770 | A | 11/2000 | Manusch et al. | 242/422.4 |
| 6,641,141 | B1 | 11/2003 | Schroeder | |

FOREIGN PATENT DOCUMENTS

| | | | |
|---|---|---|---|
| DE | 42 17 295 A1 | 12/1993 | |
| EP | 0 064 358 | 11/1982 | 464/40 |
| EP | 0679597 | 11/1995 | |
| FR | 2 559 221 | 8/1985 | 464/30 |
| IT | 287 492 | 7/1931 | 192/56 R |

* cited by examiner

*Primary Examiner*—Greg Binda
(74) *Attorney, Agent, or Firm*—Jones Day

(57) ABSTRACT

A sliding clutch for torsion-limiting force transmission between a reel and a rotating part includes two bearing members disposed concentrically within one another. One of the bearing elements is formed by a circular bearing sleeve which is radially resiliently deformable transverse to its rotational axis. The bearing sleeve and the opposing bearing member abut each other in the region of a circular joint and the force transmission is effected by frictional slaving in the region of the joint. With a view to improving the frictional slaving, a tensioning element is provided on the side of the bearing sleeve opposite the side adjacent the bearing member such that the tensioning element presses against the bearing sleeve to bias the bearing sleeve against the opposing bearing member.

10 Claims, 2 Drawing Sheets

SLIDING CLUTCH FOR A DEVICE FOR TRANSFERRING A FILM FROM A BACKING TAPE

CROSS-REFERENCE TO RELATED APPLICATIONS

This is a divisional of application No. 10/379,653, filed Mar. 6, 2003, now abandoned, which is a continuation of International Patent Application Ser. No. PCT/EP01/05671, filed May 17, 2001, which claims the benefit of European Patent Application Ser. No. EP 00119642.7, filed Sep. 8, 2000, the entire contents of which are expressly incorporated herein by reference thereto.

FIELD OF THE INVENTION

The invention relates to a sliding clutch such as for a hand-held device for transferring a film from a backing tape onto a substrate.

BACKGROUND OF THE INVENTION

A sliding clutch of this type is described in U.S. Pat. No. 4,891,090 to Lorinez et al. (corresponding to EP 0 362 697 A1). This known sliding clutch is disposed between a rotary drive member for a supply reel with the sliding clutch comprising two bearing members arranged concentrically within one another, one of these bearing members having the form of a round ring and the other bearing member being formed by a hollow cylindrical reel body. The round ring is made up of a plurality of annular segments formed by radial and axial slots which extend axially in one piece from a toothed disc while engaging concentrically in the hollow cylindrical reel body. It is guaranteed that slidable torsional slaving can be achieved by the ring segments pressing radially against the inner shell surface of the hollow cylindrical reel body with a certain amount of tensional force at its free end portions as a result of a prefabricated oversized portion.

In this known sliding clutch, it is difficult to predetermine the size of the torque at which the transmission force is to be limited. This is caused by the level having to be predetermined during manufacture of the annular segments as they have to be produced with a radially oversized section so that they abut such that they are elastically pushed together with a radial bias at the inner shell surface of the reel body in the mounted position. In doing so, it has to be taken into consideration that even slight angular deviations of the annular segments can lead to a considerable radial change in position of their effective friction surfaces and a predetermined torque restriction can therefore only be implemented within a large tolerance range. In addition, in the known design, one has to expect alterations in tension caused by relatively high stress existing at the connection point between the annular segments and the toothed disc because of the desired small design which, for one thing, is inclined to decrease stress because of the material becoming fatigued and, for another thing, leans towards an unintentional increase or decrease in frictional tension as a result of changes in shape caused by differences in temperature. For reasons connected with handling and the defect-free transportation of the backing tape and the film, it is however desired to achieve as uniform a tension of the frictional surfaces on one another and as uniform a torque slaving as possible.

U.S. Pat. No. 6,145,770 to Manusch et al. (corresponding to EP 0 883 564 B1) describes a sliding clutch for torque-limiting force transmission between a reel core and a reel for winding up or unwinding a tape which has two rotating parts arranged concentrically within one another, one of which has the shape of an oval ring with an annular wall which is radially elastically deformable towards the rotational axis and where the torsional force is transmitted by frictional slaving between the oval annular wall and the other bearing member provided in the form of a polygon. In this known structure, the ring is severely deformed and a concentric bearing of the rotating parts is not guaranteed either.

A need exists for improving the frictional slaving of a sliding clutch of the type described above while guaranteeing a simple concentric mounting. A need also exists for the improved torque-limiting transmission of force and to make it easier to predetermine the force more precisely. Furthermore, the sliding clutch should have a long lifetime with the maximum transferable torque of the force transmission not substantially changing over a longer period of time or remaining constant.

SUMMARY OF THE INVENTION

The present invention is directed to a tensioning element provided between a circular bearing sleeve and a bearing member. The tensioning element is arranged on the side of the bearing sleeve opposite the bearing member such that it presses elastically against the bearing sleeve and is thereby resiliently deformed or bends, thus elastically biasing the bearing sleeve against the bearing member. This creates frictional slaving where the circular bearing sleeve is only very slightly resiliently deformed, namely by the amount of play of the joint, wherein this measurement is just a few tenths of a millimeter and can theoretically be zero so that the radial elastic deforming or bending of the bearing sleeve is also very small and can theoretically be zero. Consequently, the elastic deforming of the tensioning element in the sense described above found in the embodiment according to the invention is also low or non-existent. Changes in tension at the bearing sleeve and at the tensioning element caused by material fatigue are therefore slight and not damaging, thus the desired long product life is achieved. In addition, the frictional surfaces form a simple concentric pivot bearing for the bearing members during sliding of the sliding clutch.

The effectiveness of the tensional force of the tensioning element can be increased or the necessary tensional force of the tensioning element can be reduced when the tensioning element is formed by a free section of the bearing sleeve which preferably extends in the longitudinal direction of the rotational axis and can be separated from the other part of the bearing sleeve by a joint or gap, especially in the form of a tongue. The partial separation from the bearing sleeve causes the free section to be connected at one end to the bearing sleeve which means that it not only cannot be lost but it is also connected in a radially resiliently flexible manner. The bearing sleeve can comprise one or several free sections which are preferably formed by one or more segments.

The tensioning element is preferably formed to be ring-shaped. The annular form can serve to hold the tensioning element itself. In addition, the annular form also means that the tensioning element can essentially spread apart or press together one or more free sections or segments distributed around the periphery more or less equally. The tensioning element is preferably formed by a quartered annular spring or a helical spring in the form of a tension or compression spring. Within the boundaries of the invention, the bearing sleeve can be disposed outside or inside the other bearing member. If the bearing sleeve is disposed inside, the other bearing member is also formed by a hollow cylindrical bearing sleeve. If the circular annular wall is disposed outside, the other bearing member can also be formed as a hollow cylindrical bearing sleeve.

Owing to the low deformation of the bearing sleeve and the tensioning element that follows it, especially when the tensioning element is formed in an annular fashion, frictional tension with a relatively small tolerance can be achieved by prefabricating the associated parts. In addition, the frictional tension remains constant, even after a long lifetime.

The sliding clutch used in the invention is particularly suitable for torque-limiting transmission of force between a reel and a rotating member of a hand-held device for applying a film from a backing tape onto a substrate. This sliding clutch can be associated to a supply reel or a take-up reel of the handpiece. The sliding clutch used in the invention is ideally suited to such a hand-held device because it has a construction which is small and inexpensive to produce and can be integrated excellently into a hand-held device.

BRIEF DESCRIPTION OF THE DRAWINGS

[Preferred features of the present invention are disclosed in the accompanying drawings, wherein similar reference characters denote similar elements throughout the several views, and wherein.

DETAILED DESCRIPTION OF THE PREFERRED EMBODIMENTS

Figure 1:
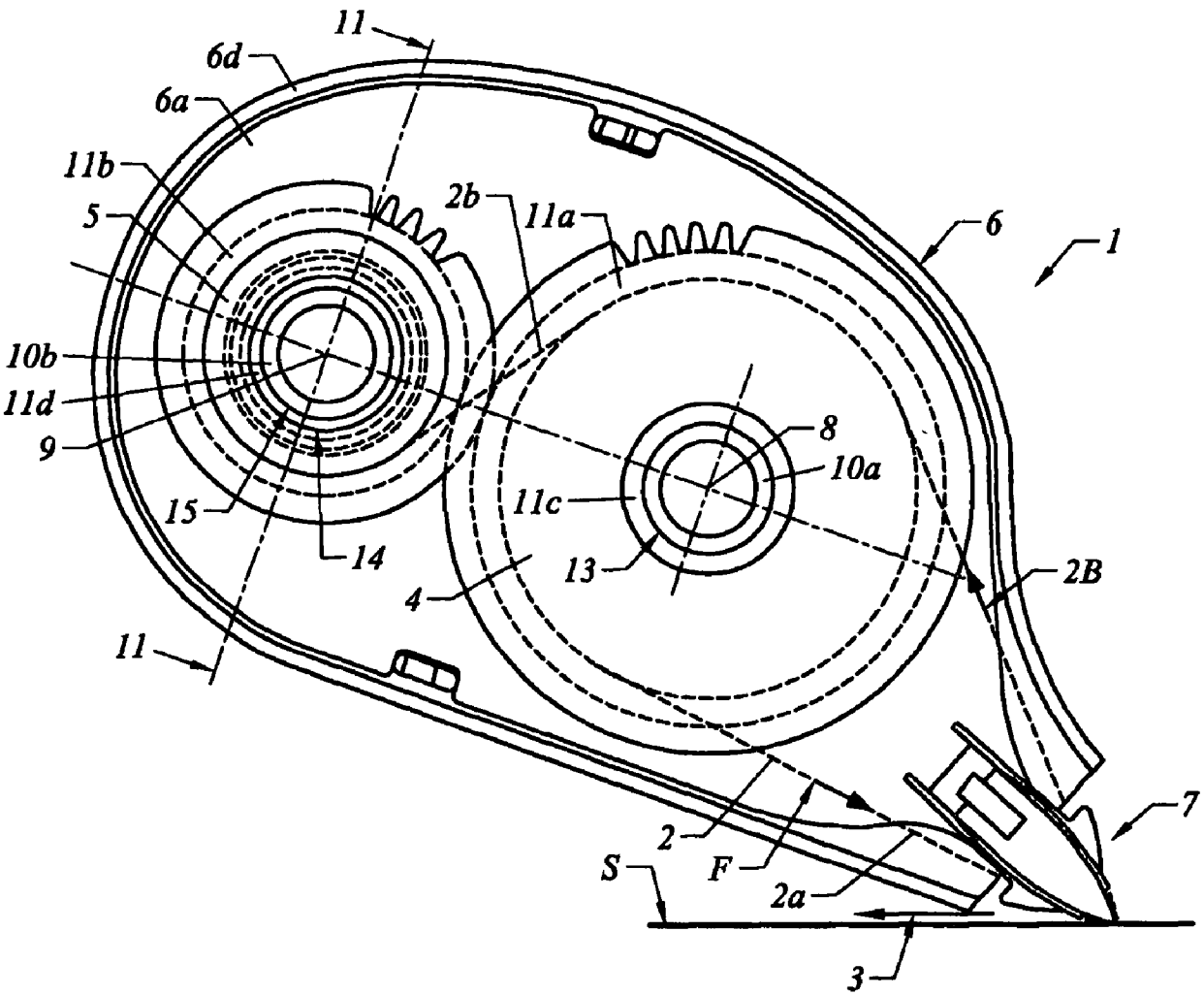
FIG. 1 shows a hand-held device for applying a film from a backing tape onto a substrate having a sliding clutch as described in the invention, the hand-held device being situated in its use position and a separable or opened housing of the hand-held device being illustrated open to one side.

The hand-held device referred to as a whole as 1 serves to transfer a film F disposed on a backing tape 2 onto a substrate S, the backing tape 2 being disposed on a supply reel 4 and a take-up reel 5 in a housing 6 of the hand-held device 1. The housing 6 has an elongated design with an essentially rectangular cross-section and is disposed in an upright position in its functioning position as per FIG. 1, which shall be described later. An application member 7 is provided protruding from the housing 6, this member being arranged in the lower section of the front end of the housing and the backing tape 2 running about it. By pressing the preferably spatula-shaped application member 7 manually on the substrate S while at the same time pushing the hand-held device in the rearwards direction 3, the lower backing tape section 2*a* can be pulled off the supply reel 4 and is automatically wound back up onto the take-up reel 5 as an upper backing tape section 2*b*. In the present exemplified embodiment, the supply reel 4 and the take-up reel 5 are mounted so as to be rotatable about two rotational axes 8, 9 extending transversely to the deflection plane E of the backing tape 2; these axes are spaced apart from each other in the lengthwise direction of the housing 6 with the take-up reel 5 being disposed behind the supply reel 4.

The housing 6 is made up of two housing parts 6*a*, 6*b*, the dividing joint 6*c* of which runs in or parallel to the deflection plane E of the backing tape. It is possible for the housing part 6*b*, shown for example on the right hand side in FIG. 2, to be formed with a shell-shaped peripheral wall 6*d* and the other housing part 6*a* to be essentially flat and fulfilling the function of a lid. The reels 4, 5 are rotatably mounted on pivot bearing parts 10*a*, 10*b* which project from the side walls of one of the housing parts 6*a*, 6*b* and are preferably formed by hollow cylindrical bearing sleeves molded onto side walls on both sides.

Between the reels 4, 5, there is disposed a drive connection 11 with an integrated sliding clutch 12. The drive connection 11 is formed such that—bearing in mind the respective effective winding diameters of the full and empty reels 4, 5—it drives the take-up reel 5 at such a speed that the backing tape section 2*b* being wound up is always slightly taut. In doing so, the sliding clutch 12 prevents the backing tape 2 from being overstretched and ripping. Once a certain effective drive torque in the drive connection 11 has been exceeded, the sliding clutch 12 activates so that, although the drive connection 11 attempts to drive the take-up reel at a higher speed, it is only driven at a speed corresponding to the speed of the backing tape 2 on the take-up surface. In the present exemplified embodiment, the drive connection 11 is formed by a toothed gearing having two meshing toothed discs 11*a*, 11*b*, each of which is rotatably mounted on the pivot bearing parts 10*a*, 10*b* with a small amount of play with a hollow cylindrical bearing sleeve 11*c*, 11*d*. The bearing sleeve 11*c* of the toothed disc 11*a* forms the supply reel 4. The latter is thus rigidly connected to the driving part of the drive connection 11 with the supply reel 4 and the toothed disc 11*a* having a common pivot bearing 13 which is formed by the pivot bearing parts or bearing sleeves disposed concentrically within one another.

The take-up reel 5 is mounted in a rotatable manner on the driven part of the drive connection 11 by a concentric pivot bearing 14, in this case on the driven toothed disc 11*b*. The pivot bearing 14 which is provided additionally to the pivot bearing 15 between the toothed disc 11*b* and the housing 6 is formed by two pivot bearing parts engaging concentrically within one another and in particular by hollow cylindrical bearing sleeves. The inner pivot bearing part of pivot bearing 14 is formed by the hollow cylindrical bearing sleeve 11*d* and the outer pivot bearing member is formed by a hollow cylindrical bearing sleeve 5*a* in the form of an annular wall 5*b* on the body of the take-up reel 5, which wall is circular on at least its inside. The bearing sleeves 11*d*, 5*a* extend in opposite axial directions to each other, one extending concentrically beyond the other socket-like with a small amount of bearing play and, in the embodiment exemplified in FIG. 2, the bearing sleeve 5*a* of the take-up reel 5 forming the outer bearing member. The bearing sleeve 5*a* is surrounded by an annular groove 5*c* which emerges from the body of the take-up reel 5 on the side facing the toothed disc 11*b* and has an axial depth which stretches over a large proportion of the width of the take-up reel 5 so that the bearing sleeve 5*a* is connected to the radially outer body part of the take-up reel 5 by a side flange wall 17 measuring for example a few millimeters in size.

The bearing sleeve 5*a* has at least one free section which is separated from the other part of the bearing sleeve 5*a* by a radial gap. This can for example be formed by the wall of the bearing sleeve 5*a* being slit by at least one slot 5*d* extending in an essentially axial direction which can extend as far as the bottom region of the annular groove 5*c* and thus to the proximity of or to the flange wall 17. The bearing sleeve 5*a* is preferably axially split into segments 5*e* by several slits 5*d* distributed along the periphery. These segments are integrally connected to the take-up reel 5 or the flange wall 17 in the region of their lower ends so that the top ends are radially resiliently flexible.

The bearing sleeve 5*a* is radially biased against the inner bearing member, in this case the bearing sleeve 11*d*, by a tensioning element 18 so that the inner shell surfaces of the segments 5*e* form slide faces which press against the associated bearing member, in this case the inner bearing sleeve 11*d*, with the tensional force exerted on it by the tensioning element 18. This forms the sliding clutch 12 with torque-limiting force transmission between the take-up reel S and the bearing sleeve 11*d* forming a rotary drive part.

The tensioning element 18 can be a pressure element which acts in a radially elastic way and resiliently deforms the bearing sleeve 5*a* at at least one position, for example at a point-focal position, and presses the bearing sleeve 5*a* against the bearing sleeve 11*d*. The tensioning element 18 can also be formed to be annular, exerting a radial force on at least one section of the circumference of the bearing sleeve 5*a*.

In the functioning mode, the driven drive connection part, in this case the toothed disc 11*b*, is driven by the supply reel 4 driven by the tape detachment wherein it carries the take-up reel 5 with it in the rotational direction as a result of the frictional slaving between the bearing sleeves 11*d*, 5*a*. When the take-up reel 5 confronts the frictional slaving with torque resistance exceeding the tape tension, the sliding clutch activates or goes into action and slides through so that the take-up reel 5 is only carried with a carrying force corresponding to the permissible tape tension and at the tape speed.

The annular tensioning element 18*a* exerts an essentially uniform radial pressure on all the segments 5*e*. This tensioning element 18 can be formed by a tension or compression element which is elastic in its longitudinal direction, for example a helical spring in the form of an open or closed ring according to FIG. 4, the spring ends of which are connected to one another, for example are hooked to one another (tension spring) or are preferably supported on one another (compression spring). The radial force acted upon the segments 5*e* is achieved by a thus formed tensioning ring 18*a* pressing the segments 5*e* together or spreading them apart by virtue of the tensioning ring 18*a* contracting or stretching in the peripheral direction.

Figure 6:
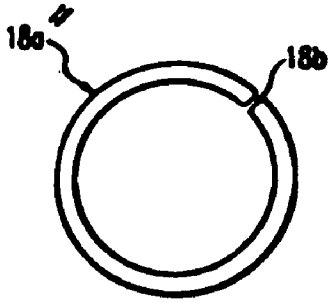
FIG. 6 shows a tensioning element of FIG. 4 in a modified configuration.

The tensioning element 18 can also be formed by a spring ring which acts in an elastic maimer in a radial direction rather than in a circumferential direction. A spring ring made of resilient material as shown in FIG. 6 is particularly suitable for this use, this ring having a slot 18*b* running in the transverse direction.

The radial size of the tensioning element 18 in a relaxed state is to be measured such that the tensioning element 18 exerts the desired tension in a mounted and taut state.

Figure 2:
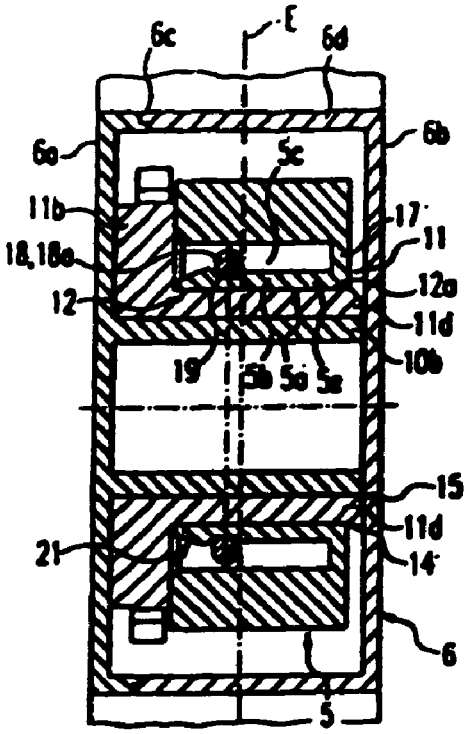
FIG. 2 shows a cross-sectional view along line II—II of FIG. 1.

The tensioning element 18 is preferably located in the outer lengthways half of the bearing sleeve 5*a* or in the free end region thereof, as is shown in FIG. 2. To position the tensioning ring 18*a* axially, an annular groove 19 can be disposed in the outer shell surface of the bearing sleeve 5*a* or the segments 5*e*. To make it easier to push the tensioning ring 18*a* onto the bearing sleeve 5*a*, the bearing sleeve has a slanted or rounded insertion surface 21 on its free end, which, on the segments 5*e*, are insertion surface parts. The radial width of the annular groove 5*c* is of such a size that there is a gap between the tensioning ring 18*a* and the groove wall surrounding it.

Figure 4:
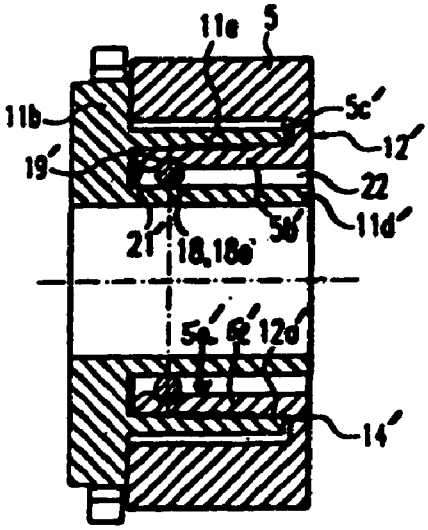
FIG. 4 shows a view similar to that of FIG. 2, but in a modified configuration.

The embodiment exemplified in FIG. 4, in which the same parts are provided with the same reference numbers, and similar parts are provided with the same reference numbers followed by a prime sign ( '), differs from the exemplified embodiment described above in that the bearing sleeve 5*a* and the segments 5*e'* are elastically biased radially outwards rather than radially inwards by the tensioning ring 18*a*. In this embodiment, the bearing sleeve 5*a'* or the segments 5*e'* work together with a bearing part surrounding them, this bearing part being formed by a hollow cylindrical bearing sleeve lie which projects axially in a concentric manner from the toothed disc 11*b* and submerges into the annular groove 5*c'* made to be the appropriate size with radial play. In this embodiment, the bearing sleeve 5*a'* or the segments 5*e'* and the bearing sleeve lie form the pivot bearing 14' for the take-up reel 5'.

In this exemplified embodiment, the annular groove 19' and the insertion surface 21' are arranged on the inside of the bearing sleeve 5*a'* or segments 5*e'*. Between the bearing sleeve 11*e* and the bearing sleeve 11*d'* there is arranged an annular groove 22 open at one side. Groove 22 has such a radial width that there is a free space between the tensioning element 18 and the outer shell surface of the bearing sleeve 11*d'*.

Figure 3:
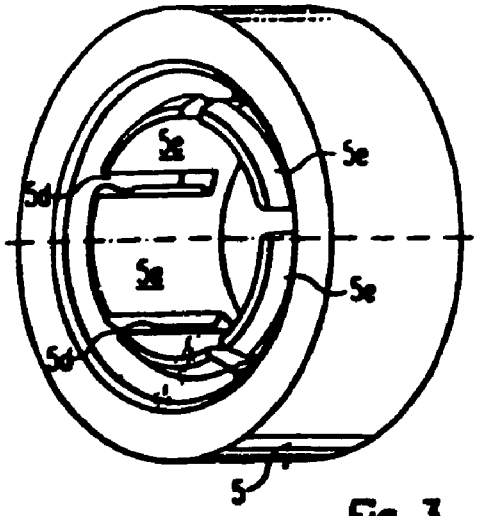
FIG. 3 shows a take-up reel in a perspective side view.
Figure 5:
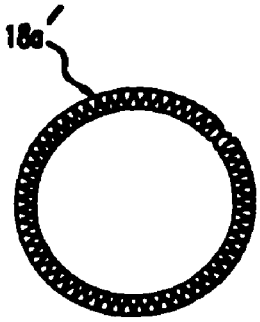
FIG. 5 shows a side view of a tensioning element of the sliding clutch in enlarged form.

In the embodiment exemplified in FIG. 3, the tensioning ring 18*a* can be formed by a resilient pressure element which acts in its longitudinal direction, for example a compression spring in the form of a helical spring 18*a'*. (FIG. 5) or a spring ring 18*a'* (FIG. 6) slit with a slot 18*b*, this spring being radially biased outwards.

Figure 7:
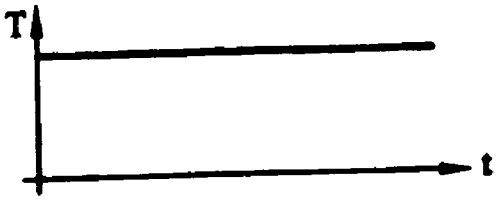
FIG. 7 shows a diagram illustrating the stress course versus time.

The sliding surfaces of the sliding clutch 12 used in the invention abut one another at a round or hollow cylindrical joint 12*a* either directly or with a small amount of play. Only a very small radial movement—or in the case of abutment just the exertion of pressure—is required to achieve the rotational slaving based on the frictional action. Due to the low amount of radial movement, the material of the bearing sleeve 5*a* is stressed just slightly or not at all. No material fatigue or reduction of the frictional action as a result of material fatigue or aging therefore has to be expected. The tension T of a long life is made clear by FIG. 7 given lifetime t.

All the part of the invention, including tentioning ring 18*a* and the tensioning element 18, can be made of plastic. The tensioning ring 18*a* is preferable made of flexable metal, especially spring steel, so that the favorable spring constants can be exploited.

To prevent the reels 4, 5 from rotating backwards, for example as a result of tensions in the backing tape 2, one of the two reels 4, 5 has an associated return stop (not illustrated) which can for example be formed by a locking pawl (not illustrated) which works together with one of the toothed wheels 11*a*, 11*b*.

In all the exemplary embodiments, it is possible and, with a view to improving the alignment of the slide faces, favorable to arrange an annular recess in the central portion of one and/or the other of the sliding surfaces of the joint 12*a*, 12*a'* or to contrast the sliding surfaces Z-shaped to one another as shown by FIG. 4. In the latter embodiment, the joining together of the bearing parts is also simplified.

The invention claimed is:

1. A sliding clutch for torque-limiting transmission of force between a reel and a rotating member, said sliding clutch comprising:

at least two bearing members disposed concentrically within one another, wherein at least one of the bearing members is capable of being formed by a circular bearing sleeve which is radially elastically deformable transversely to its rotational axis, wherein the bearing sleeve and the other bearing member abut each other in a region of a circular joint and a torsional force is capable of being transmitted by means of frictional slaving in the region of the circular joint, and a tensioning element arranged on a side of the bearing sleeve opposite the other bearing member in such a way that it presses against the bearing sleeve, thus biasing the bearing sleeve against the other bearing member, and wherein the tensioning element has the form of a closed ring.

2. A sliding clutch according to claim 1, wherein the tensioning element presses against at least one free section of the bearing sleeve.

3. A sliding clutch according to claim 2, wherein the free section is separated from the other part of the bearing sleeve by a radial gap.

4. A sliding clutch according to claim 2, wherein the free section extends in a longitudinal direction of the rotational axis and is connected to the bearing sleeve with a base wall at an axial end.

5. A sliding clutch according to claim 2, wherein one or several free sections is/are formed by one or several segments of the bearing sleeve.

6. A sliding clutch according to claim 1, wherein the bearing sleeve has at least one slit which extends in a substantially axial direction.

7. A sliding clutch according to claim 1, wherein the tensioning element is formed by a helical spring.

8. A sliding clutch according to claim 1, wherein the tensioning element is surrounded by the bearing sleeve and presses radially outwards against the bearing sleeve.

9. A sliding clutch according to claim 1, wherein said sliding clutch is integrated in a drive connection between a supply reel and a take-up reel of a hand-held device for applying a film of adhesive or covering or colored material onto a substrate, between the take-up reel and a rotary drive member for the take-up reel.

10. A tape dispenser that includes a sliding clutch for torque-limiting transmission of force between a reel and a rotating member, said sliding clutch comprising:

at least two bearing members disposed concentrically within one another, wherein at least one of the bearing members is capable of being formed by a circular bearing sleeve which is radially elastically deformable transversely to its rotational axis, wherein the bearing sleeve and the other bearing member abut each other in a region of a circular joint and a torsional force is capable of being transmitted by means of frictional slaving in the region of the circular joint, and a tensioning element arranged on a side of the bearing sleeve opposite the other bearing member in such a way that it presses against the bearing sleeve, thus biasing the bearing sleeve against the other bearing member, and wherein the tensioning element has the form of a closed ring.

* * * * *